United States Patent [19]

Piorr et al.

[11] Patent Number: 4,744,923

[45] Date of Patent: May 17, 1988

[54] USE OF ALKYLAMINOPOLYGLYCOL ETHERS AS FOAM-DEPRESSING ADDITIVES IN LOW-FOAM DETERGENT PREPARATIONS

[75] Inventors: Robert Piorr, Ratingen-Hösel; Gilbert Schenker, Erkrath, both of Fed. Rep. of Germany

[73] Assignee: Henkel Kommanditgesellschaft auf Aktien, Duesseldorf, Fed. Rep. of Germany

[21] Appl. No.: 44,927

[22] Filed: Apr. 30, 1987

[30] Foreign Application Priority Data

May 2, 1986 [DE] Fed. Rep. of Germany ..... 3614825

[51] Int. Cl.[4] ..... C11D 7/22; C11D 7/06

[52] U.S. Cl. ..... 252/544; 252/174.21; 252/174.22; 252/321; 252/156

[58] Field of Search ..... 252/174.23, 321, 156, 252/174.21, 544, 525; 564/505

[56] References Cited

U.S. PATENT DOCUMENTS 4,301,083 11/1981 Yoshimura ..... 260/404

*Primary Examiner*—Paul Lieberman
*Assistant Examiner*—Isabelle Rodriquez
*Attorney, Agent, or Firm*—Ernest G. Szoke; Henry E. Millson, Jr.; Real J. Grandmaison

[57] ABSTRACT

Alkylaminopolyethylene glycol ethers corresponding to the following formula

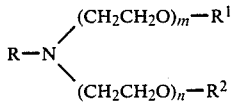

in which R represents a $C_6$–$C_{20}$ alkyl or alkenyl radical, $R^1$ and $R^2$ are the same or different and represent a $C_1$–$C_8$ alkyl radical and the indices m and n are the same or different and represent a number of from 3 to 20, with the proviso that the sum of m and n is from 5 to 25, are suitable as foam inhibitors for detergent preparations. The foam inhibitors are stable to strong alkalis and strong acids and may be used in concentrations of from 10 to 2500 ppm.

14 Claims, No Drawings

USE OF ALKYLAMINOPOLYGLYCOL ETHERS AS FOAM-DEPRESSING ADDITIVES IN LOW-FOAM DETERGENT PREPARATIONS

BACKGROUND OF THE INVENTION

1. Field of the Invention

This invention relates to the use of terminal-group-blocked alkylaminopolyethylene glycol ethers as foam-depressing additives in low-foam detergent formulations.

2. Discussion of Related Art

Institutional and industrial aqueous detergent preparations, particularly those intended for cleaning metal, glass, ceramic and plastic surfaces, generally contain compounds which are capable of counteracting undesirable foaming during their use. In most cases, the use of foam-depressing additives is necessitated by the fact that the various types of soil detected from the substrates and accumulating in the cleaning baths act as foam generators. In addition, the use of antifoam agents may also be necessitated by the fact that the detergent preparations themselves contain constituents which give rise to undesirable foaming under the particular in-use conditions, for example, anionic surfactants or nonionic surfactants which foam at the in-use temperature.

DESCRIPTION OF THE INVENTION

The present invention relates to the use of terminal-group-blocked alkylaminopolyethylene glycol ethers corresponding to formula I below as a foam-depressing additive for low-foam detergent preparations:

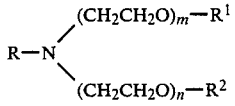

(I)

In formula I, R represents a $C_6$–$C_{20}$ alkyl or alkenyl radical, $R^1$ and $R^2$ independently of one another represent a $C_1$–$C_8$ alkyl radical, m and n independently of one another is a number of from about 3 to about 20, with the proviso that the sum of m and n is from about 5 to about 25.

The substituents R, $R^1$ and $R^2$ may be straight-chain or branched. R is preferably a straight-chain alkyl radical (oxo synthesis radical) containing from 8 to 18 carbon atoms. Suitable radicals include octyl, decyl, dodecyl, tetradecyl, hexadecyl and octadecyl radicals and also mixtures thereof, of the type present in synthetic mixtures or obtained from natural fats, for example, cocosalkyl radicals or tallow alkyl radicals. The radicals $R^1$ and $R^2$ preferably contain from 3 to 6 and more especially 3 or 4 carbon atoms. Examples are propyl, isopropyl, butyl and isobutyl radicals. The indices m and n preferably have a value of from 3 to 10, their sum preferably being from 5 to 15.

The compounds may be prepared by methods known per se, for example, by ethoxylating alkylamines corresponding to the formula R—$NH_2$, converting the polyglycol ethers formed into the alkali metal alcoholates, and reacting the alkali metal alcoholates with alkylchlorides or alkylbromides such as by "WILLIAMSON" etherification. The etherification may be carried out with an excess of alkylhalide which is removed by distillation on completion of the reaction. The etherification may be carried out for example at 60° to 120° C., and takes from about 30 minutes to 6 hours, depending on the temperature selected. When low-boiling alkylchlorides, for example, propylchloride (47° C.) and butylchloride (80° C.) are used, the reaction may even be carried out in a pressure vessel. On completion of the reaction, the excess alkali is best neutralized and filtered off together with the alkylhalides formed during the etherification.

The compounds of formula I obtained are colorless in pure form and liquid at room temperature.

The compounds corresponding to formula I may be used by themselves or in combination with other foam inhibitors, particularly polyethylene glycol ethers of the type which may be obtained by addition of from 4 to 20 parts by weight of ethylene oxide onto 1 part by weight of polyglycerol having a hydroxyl number of from 900 to 1200 and subsequent etherification of the free hydroxyl groups with a $C_4$–$C_8$ alkylhalide, and which are described in U.S. Pat. No. 4,522,740. Mixtures such as these of the polyethyleneglycol ethers and the terminal-group-blocked alkylaminopolyethylene glycol ethers of formula I defined above in a ratio by weight of from 1:1 to 9:1, and preferably of from 2.3:1 to 9:1, have a particularly pronounced foam-depressing effect.

The compounds used in accordance with this invention are liquid at room temperature. They are distinguished by high alkali and acid stability and by very effective foam inhibition in mildly acidic to strongly alkaline detergent solutions.

The detergent preparations in which the compounds of formula I are used in accordance with this invention may contain the constituents typically used in such preparations, such as wetting agents, builders and complexing agents, alkalis or acids, corrosion inhibitors and, optionally, antimicrobial agents and/or organic solvents. Suitable wetting agents include nonionic surface-active compounds, such as polyglycol ethers obtained by addition of ethylene oxide onto alcohols, particularly fatty alcohols, alkyl phenols, fatty amines and carboxylic acid amides, and anionic wetting agents, such as alkali metal, amine and alkylolamine salts of fatty acids, alkyl sulfuric acids, alkyl sulfonic acids and alkylbenzene sulfonic acids. The detergent preparations may contain as builders and complexing agents, preferably, alkali metal orthophosphates, polymer phosphates, silicates, borates, carbonates, polyacrylates and gluconates, and also citric acid, nitriloacetic acid, ethylenediamine tetraacetic acid, 1-hydroxyalkyl-1,1-diphosphonic acid, aminotrimethylenephosphonic acid and ethylenediamine tetramethylenephosphonic acid, phosphonoalkane polycarboxylic acids, such as phosphonobutane tricarboxylic acid for example, and alkali metal salts of these acids. Highly alkaline detergent preparations, particularly those used for bottle washing, contain considerable quantities of caustic alkali in the form of sodium and potassium hydroxide. If it is desired to obtain particular cleaning effects, the detergent preparations may contain organic solvents, for example alcohols, petroleum fractions and chlorinated hydrocarbons, and free alkylolamines.

In the context of this invention, detergent preparations are understood to mean, on the one hand, the aqueous solutions intended for direct application to the substrates to be cleaned. On the other hand, detergent preparations in the context of this invention are also understood to mean the concentrates and solid mixtures intended for the preparation of the in-use solutions.

The ready-to-use solutions may be mildly acidic to strongly alkaline.

The compounds of formula I used in accordance with this invention are added to the detergent preparations in such quantities that they are present in the ready-to-use solutions in a concentration of from 10 to 2500 ppm, and preferably in a concentration of from 50 to 500 ppm.

EXAMPLES

Preparation of the compounds:

341 g (0.65 mole) of an n-octylamine reacted with 10 moles of ethylene oxide (EO) were mixed with 164 g of potassium hydroxide having a water content of 11%, based on KOH (2.6 moles).

240.5 g of n-butylchloride (2.6 moles) were then added and the mixture heated with stirring for 4 hours to 80° C. in an inert gas atmosphere. After neutralization of the excess alkali with acetic acid, excess butylchloride and water were distilled off, ultimately in vacuo at 150° C. The still warm product was freed from precipitated salts by filtration. The product had an amine number of 83 and a hydroxyl number of 12, i.e. small numbers of hydroxyl groups were still present. The cloud point was below 5° C.

The compounds listed in Table 1 were synthesized in the same way.

TABLE 1

| Example No. | R | m + n | $R^1$, $R^2$ | Amine number | OH number |
|---|---|---|---|---|---|
| 1 | n-octyl | 10 | n-butyl | 83 | 12 |
| 2 | n-dodecyl | 10 | n-butyl | 82 | 16 |
| 3 | n-tetradecyl | 10 | n-butyl | 78 | 14 |
| 4 | n-hexadecyl | 10 | n-butyl | 80 | 18 |
| 5 | n-octadecyl | 10 | n-butyl | 74 | 28 |
| 6 | n-dodecyl | 6 | n-butyl | 86 | 10 |
| 7 | n-dodecyl | 14 | n-butyl | 80 | 15 |
| 8 | n-decyl | 10 | n-propyl | 82 | 12 |

Preparation of the terminal-group-blocked polyglycerol polyethylene glycol ethers according to German patent application 33 15 962:

137 g of polyglycerol having a hydroxyl number of 961 were reacted in an autoclave at 180° C./10 bar with 1488 g of ethylene oxide (ratio by weight 1:10.9) in the presence of 3 g of sodium methylate. 1313 g of polyglycerol ethylene glycol ether having a hydroxyl number of 113 were obtained.

350 g of the product obtained, 171 g of n-hexylchloride, and 228 g of a 75% by weight sodium hydroxide solution were stirred for 4 hours at 120° C. The aqueous phase was separated off from the cooled reaction mixture. The organic phase was washed with water at 50° C. until the washing liquid showed a neutral reaction. Unreacted hexylchloride and water were removed from the reaction mixture by heating in vacuo to 150° C. 281.5 g of polyglycerol polyethylene glycol hexylether (polyglycerol-10.9 butyl-EO) were obtained. The hydroxyl number of the product was 3.5. The reaction product is referred to hereinafter as product B.

Testing of the defoaming effect:

The antifoaming effect was evaluated using test solutions containing 1% by weight of sodium hydroxide and 0.03% by weight (300 ppm) of defoaming agent. In the tests, triethanolamine tetrapropylene benzene sulfonate was added to these solutions as a test foaming agent in quantities increasing in stages of 100 ppm.

Quantities of 200 ml of the test solutions were tested at 65° C. in a foam beating apparatus according to DIN 53 901. In each case, the foam volume in ml was read off 5 seconds after a series of 100 beats in 100 seconds. An average value was determined from 5 individual measurements for each concentration of test foaming agent. From the results obtained, the foam volume observed at a concentration of the test foaming agent of 1000 ppm is shown in the second column of Table 2 below. The concentration of test foaming agent at which a foam volume of more than 200 ml was measured for the first time is shown as a second representative measured value in the third column of Table 2.

TABLE 2

| Defoaming agent of Example No. | Ml. foam at 1000 ppm test foaming agent | Ppm test foaming agent for 200 ml foam |
|---|---|---|
| 1 | 35 | 2100 |
| 2 | 30 | 2000 |
| 3 | 40 | 1800 |
| 4 | 45 | 1600 |
| 5 | 45 | 1500 |
| 6 | 40 | 1800 |
| 7 | 30 | 2000 |
| 8 | 50 | 1400 |

EXAMPLE 9

A storable, granular bottle washing detergent was prepared by mechanically mixing the following components (pbw=parts by weight):

80 pbw caustic soda,
12 pbw sodium tripolyphosphate,
5 pbw sodium silicate (molar ratio $Na_2O:SiO_2=3.35$), and
3 pbw product of Example 1.

Using a 1% by weight solution of this detergent, milk bottles were washed at 80° C. in a commercial bottle washing machine with one liquor zone and a capacity of 18,000 bottles per hour. The cleaning effect was good and no troublesome foaming was observed.

EXAMPLE 10

A storable, granular active-component mixture was prepared by mechanically mixing the following components:

80 pbw sodium tripolyphosphate, and
20 pbw product of Example 6.

Beer bottles were washed at 85° C. in a bottle washing machine with three liquor zones and a capacity of 80,000 bottles per hour. The beer bottles were labeled with paper labels using a casein glue which would normally produce heavy foaming in the immersion baths. When 1.5% of the active-component mixture described above was used as the washing solution, the machine could be operated without any troublesome foaming.

EXAMPLE 11

A storable, active-component mixture was prepared by mechanically mixing the following components:

40 pbw sodium ethylenediamine tetraacetate,
20 pbw sodium tripolyphosphate,
30 pbw sodium gluconate, and
10 pbw product of Example 1.

Wine bottles were washed at 85° C. in a commercial bottle washing machine with two separate liquor zones and a capacity of 24,000 bottles per hour. 1.5% sodium hydroxide to which 0.5% by weight of the abovedescribed concentrate had been added was used as the washing solution. Washing was completed without troublesome foaming and the bottles put through the machine were satisfactorily clean.

EXAMPLE 12

A detergent concentrate was prepared by dissolving the following components in phosphoric acid:
5 pbw aminotri-methylenephosphonic acid,
10 pbw 1-hydroxyethane-1,1-diphosphonic acid,
5 pbw phosphonobutane tricarboxylic acid,
27 pbw product of Example 1,
3 pbw product B,
10 pbw ethanol, and
40 pbw phosphoric acid, 75% by weight.

Mineral water bottles were washed at 80° C. in a conventional bottle washing machine having three liquor zones. The detergent solution used was a 2% by weight sodium hydroxide solution to which 0.1% by weight of the above-described concentrate had been added. Cleaning was completed without troublesome foaming and the bottles put through the machine were satisfactorily clean.

EXAMPLE 13

A storable detergent for the spray cleaning of metal surfaces was prepared by mechanically mixing the following components:
80 pbw sodium metasilicate pentahydrate,
16 pbw sodium tripolyphosphate,
4 pbw cocosamine containing 12 moles of ethylene oxide, and
1 pbw product of Example 1.

The foaming and foam collapse of a 2% by weight solution of this detergent were tested in accordance with DIN 53 902 at 60° C. by comparison with a detergent of the same composition, but without the addition of the product of Example 1. The results are shown in Table 3 below.

TABLE 3

| Detergent | Ml. foam after mins. | | | |
|---|---|---|---|---|
| | 0 | 1 | 2 | 10 |
| Comparison | 530 | 140 | 0 | 0 |
| Invention | 160 | 10 | 0 | 0 |

EXAMPLE 14

A degreasing dip for metals was prepared by mechanically mixing the following components:
40 pbw sodium metasilicate pentahydrate,
35 pbw sodium carbonate,
20 pbw sodium tripolyphosphate,
2.5 pbw sodium alkylbenzene sulfonate,
2.5 pbw nonylphenol containing 14 moles of ethylene oxide,
4.5 pbw product of Example 1, and
0.5 pbw product B.

Grease-soiled steel articles were cleaned by dipping in a 4% by weight solution of this detergent at 60° C. The degreasing effect was very good and no troublesome foaming was observed.

EXAMPLE 15

A storable concentrate for cleaning metal surfaces was prepared by dissolving the following components in water:
30 pbw sodium caprylate,
10 pbw borax,
14 pbw sodium tripolyphosphate,
10 pbw triethanolamine,
2 pbw monoethanolamine,
6 pbw product of Example 1, and
78 pbw water.

Iron surfaces were sprayed with a 1.5% by weight solution of this detergent (pH value 8.5) at 50° to 55° C. The cleaning effect was good and no troublesome foaming was observed.

EXAMPLE 16

A storable concentrate for cleaning metal surfaces was prepared by dissolving the following components in water:
25 pbw diethanolamine salt of isononanoic acid,
20 pbw diethanolamine,
1 pbw benztriazole,
4 pbw product of Example 6, and
50 pbw water.

Grey iron castings were sprayed with a 1% solution of this detergent at 50° to 55° C. The cleaning effect was good and no troublesome foaming was observed.

What is claimed is:

1. The process of suppressing foam in an aqueous detergent solution comprising contacting said solution with from about 10 to about 2500 ppm of a terminal-group-blocked alkylaminopolyethylene glycol ether corresponding to the following formula

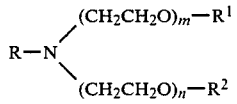

wherein R represents a $C_6$–$C_{20}$ alkyl or alkenyl radical, $R^1$ and $R^2$ independently of one another represent a $C_1$–$C_8$ alkyl radical, m and n independently of one another is a number of from about 3 to about 20, with the proviso that the sum of m and n is from about 5 to about 25.

2. The process in accordance with claim 1 wherein R, $R^1$ and $R^2$ is a straight-chain radical or a branched-chain radical.

3. The process in accordance with claim 1 wherein R is a straight-chain alkyl radical or an alkyl radical which is methyl-branched in the 2-position containing from 8 to 18 carbon atoms.

4. The process in accordance with claim 1 wherein $R^1$ and $R^2$ contain from 3 to 6 carbon atoms.

5. The process in accordance with claim 1 wherein m and n independently of one another have a value of from 3 to 10, with the proviso that their sum is from 5 to 15.

6. The process in accordance with claim 1 including contacting said solution with a foam-depressing effective amount of a polyethylene glycol ether obtained by the addition of from 4 to 20 parts by weight of ethylene oxide onto 1 part by weight of polyglycerol having a hydroxyl number of from about 900 to about 1200 and subsequent etherification of the free hydroxyl groups with a $C_4$–$C_8$ alkylhalide.

7. The process in accordance with claim 6 wherein said polyethylene glycol ether and said alkylaminopolyethylene glycol ether are present in a ratio by weight of from about 1:1 to about 9:1.

8. The process in accordance with claim 1 wherein said detergent solution comprises a wetting agent, builder, complexing agent, alkali metal, acid, corrosion inhibitor, anti-microbial agent, and organic solvent.

9. A composition having foam-suppressing properties in an aqueous detergent solution, said composition comprising a terminal-group-blocked alkylaminopolyethylene glycol ether corresponding to the following formula

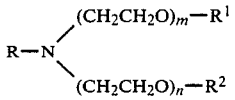

wherein R represents a $C_6$–$C_{20}$ alkyl or alkenyl radical, $R^1$ and $R^2$ independently of one another represent a $C_1$–$C_8$ alkyl radical, m and n independently of one another is a number of from about 3 to about 20, with the proviso that the sum of m and n is from about 5 to about 25, and a polyethylene glycol ether obtained by the addition of from 4 to 20 parts by weight of weight of ethylene oxide onto 1 part by weight of polyglycerol having a hydroxyl number of from about 900 to about 1200 and subsequent etherification of the free hydroxyl groups with a $C_4$–$C_8$ alkylhalide.

10. The composition in accordance with claim 9 wherein R, $R^1$ and $R^2$ is a straight-chain radical or a branched-chain radical.

11. The composition in accordance with claim 9 wherein R is a straight-chain alkyl radical or an alkyl radical which is methyl-branched in the 2-position containing from 8 to 18 carbon atoms.

12. The composition in accordance with claim 9 wherein $R^1$ and $R^2$ contain from 3 to 6 carbon atoms.

13. The composition in accordance with claim 9 wherein m and n independently of one another have a value of from 3 to 10, with the proviso that their sum is from 5 to 15.

14. The composition in accordance with claim 9 wherein said polyethylene glycol ether and said alkylaminopolyethylene glycol ether are present in a ratio by weight of from about 1:1 to about 9:1.

* * * * *